United States Patent [19]

Clark

[11] 4,079,870

[45] Mar. 21, 1978

[54] PISTOL HOLSTER

[75] Inventor: Earl J. Clark, Frederick, Md.

[73] Assignee: Tandy Brands, Inc., Fort Worth, Tex.

[21] Appl. No.: 676,686

[22] Filed: Apr. 14, 1976

[51] Int. Cl.[2] ..... F41B 13/04

[52] U.S. Cl. ..... 224/2 B; 224/3

[58] Field of Search ..... 224/2 B, 2 C, 2 A, 2 R, 224/5 R, 5 A, 5 H, 5 E, 5 MC, 26 R, 26 B, 26 D, 26 K, 3, 19

[56] References Cited

U.S. PATENT DOCUMENTS

| | | | |
|---|---|---|---|
| 653,779 | 7/1900 | Phillips | 224/2 B |
| 1,320,751 | 11/1919 | Freyer | 224/2 B |
| 2,051,844 | 8/1936 | Green | 224/2 B |
| 2,869,768 | 1/1959 | Gainsburgh | 224/2 B |
| 3,565,303 | 2/1971 | Kippen | 224/2 B |
| 3,777,952 | 12/1973 | Theodore | 224/2 B |
| 3,902,639 | 9/1975 | Rogers | 224/2 B |
| 3,923,214 | 12/1975 | Kippen | 224/2 B |
| 3,977,583 | 8/1976 | Bianchi et al. | 224/2 B |

*Primary Examiner*—Drayton E. Hoffman
*Assistant Examiner*—Donald W. Underwood
*Attorney, Agent, or Firm*—Robert A. Felsman

[57] ABSTRACT

A pistol holster having features to prevent unauthorized withdrawal by an assailant. The holster has a body of flexible material, closed at the front and rear to define a pocket for receiving a pistol. The upper rear portion of the holster has a trigger guard pocket for receiving the trigger guard member. The trigger guard pocket extends up over a portion of the trigger guard member so that if the pistol is drawn from a rearwardly direction with respect to the barrel axis, the trigger guard pocket will exert a substantial drag on the pistol, preventing the withdrawal. The trigger guard pocket leaves a portion of the trigger guard uncovered at the top so that the pistol may easily be withdrawn in the direction parallel with its barrel axis. The belt loop assembly has a threaded screw connected between the body and belt loop assembly to selectively pull the holster body tightly against the user, providing rigidity and making the pistol less accessible to an assailant. A second threaded screw is connected between the two sides of the loop to draw the bottom together, preventing slippage of the holster along the belt.

1 Claim, 5 Drawing Figures

PISTOL HOLSTER

BACKGROUND OF THE INVENTION

1. Field of the Invention

This invention relates in general to holsters, and in particular to an improved feature preventing unauthorized withdrawal in a holster of the type wherein the pistol is drawn by pulling upwardly.

2. Decription of the Prior Art

A continuing problem faced by police officers is preventing withdrawal of their pistols from the rear by an assailant. There are various holster designs with features to prevent unauthorized withdrawal. One type of holster has an opening extending along the front edge with the sides pressing against the pistol, so that the pistol is withdrawn by pressing forward. An assailant from the rear would normally pull rearward and upward, thus these holsters have features to prevent the upward withdrawal. For example, there may be an internal shoulder bearing against the top of the revolver cylinder. Also there may be a trigger guard pocket that covers the trigger guard member, such as shown in my U.S. Pat. Des. 234,137.

These safety features can not be used with conventional holsters that are closed at the front and rear since the pistol is drawn by pulling in an upward direction. Many officers prefer the conventional type holster as opposed to the open front holster, therefore it is desirable to provide additional safety features in the conventional type holster that prevent unauthorized withdrawal by an assailant.

Another disadvantageous feature of pistol holsters that makes them more subsceptible to being withdrawn by an assailant is that frequently there is a substantial gap between the pistol handle and the user's body. A certain amount of space is necessary to facilitate drawing of the revolver by the officer, however a large gap also makes the pistol easier to be grabbed by an assailant. Many holsters have a reinforcing plate between the belt loop assembly and holster body that is bent at a fixed angle to prevent the handle from protruding outward too far. Reinforcing plates, however, can be accidentally bent by an officer when seated, thus changing the desired angle. In addition, officers frequently may desire to change the angle to provide a better fit and to allow a jacket to be inserted within the gap. In warmer weather, when no jacket is required, the additional space between the belt loop assembly and pistol handle may be unnecessarily wide.

Another disadvantageous feature of pistol holsters is that the holster material, normally leather, softens with wear, thus the belt loop looses its firm grip on the belt, allowing the holster to slide along the belt. A slipping holster is disconcerting to the user, and the looseness makes it easier for an assailant to obtain the revolver in a struggle with the officer.

SUMMARY OF THE INVENTION

It is accordingly a general object of this invention to provide an improved pistol holster of the upwarddrawn type that will prevent withdrawal from the rear by an assailant.

It is a further object to provide an improved pistol holster that allows the user to select the amount of space between the pistol handle and holster belt loop assembly.

It is a further object to provide an improved belt loop assembly for a pistol holster that provides a tight connection with the belt to prevent slippage and is adjustable to compensate for wearing of the holster material.

In accordance with these objects, an improved holster is provided that has a trigger guard pocket on the upper rear side. The pocket extends upward past the lower half of the trigger guard member so that if an assailant draws from the rearward direction, the pocket will exert a substantial drag on the trigger guard member, preventing the withdrawal of the pistol. The upper contact of the pocket with the trigger guard member is sufficiently low, however, so that the pistol may be freely withdrawn in the direction parallel to the barrel.

The belt loop assembly and inner side of the holster are reinforced and are connected together by a threaded screw. The screw may be adjusted to selectively vary the distance between the loop and holster, keeping the pistol handle as tightly against the user as desired. A second threaded screw is connected between the loops of the belt loop assembly adjacent the bottom of the passage in the loop, to squeeze the bottom of the belt tightly between the loops, preventing slippage.

DESCRIPTION OF THE PREFERRED EMBODIMENT

Figure 1:
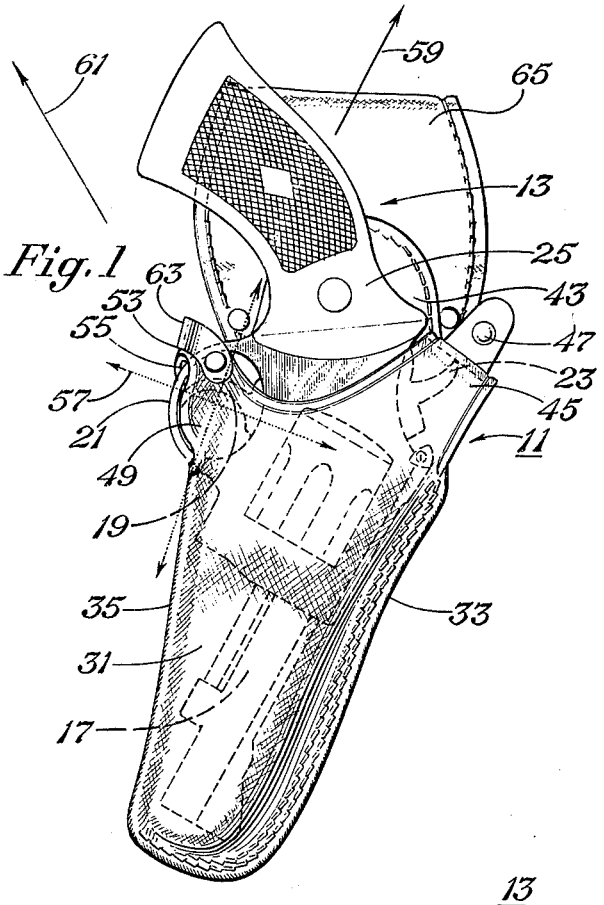
FIG. 1 is an elevational view of the outer side of the holster in accordance with this invention.

Referring to the figures, a holster 11 is shown carrying a revolver-type pistol 13. This holster is designed to be worn on a belt 15, FIG. 3, at the user's side. Typically the pistol 13 to be carried within this type of holster is a revolver having a barrel 17, trigger 19, trigger guard 21, hammer 23 and handle 25.

Figure 5:
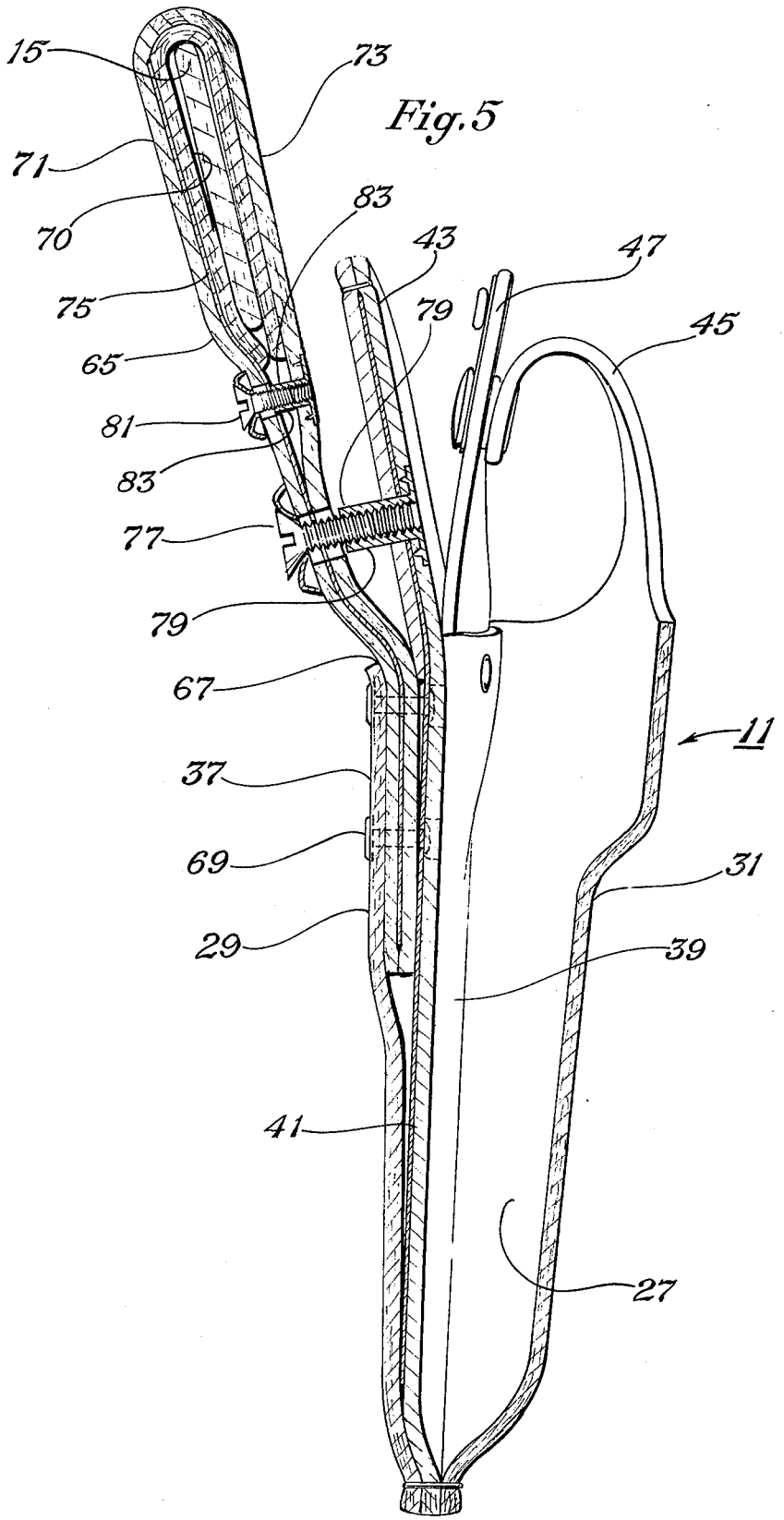
FIG. 5 is a partial cross-sectional view of the holster of FIG. 3 taken along the line V-V.

Pistol 13 is received within a gun receiving pocket 27, FIG. 5, that is defined by a holster body having an inner side 29 and outer side 31. The inner and outer sides 29, 31 are of holster material, such as leather, and closed at the front 33 and rear 35, FIG. 1. The pocket 27 is sized for a snug fit so that the pistol can not move laterally within the pocket. The top of the pistol 13 near the hammer 23 contacts the front 33 and the trigger guard 21 contacts the rear 35, preventing any play. Referring to FIG. 5, the inner side has an external layer 37 and an internal layer 39 separated by a piece of reinforcing metal 41. Reinforcing metal 41 extends substantially the full length of the holster, terminating at the upper rounded end 43 of the inner side.

Figure 2:
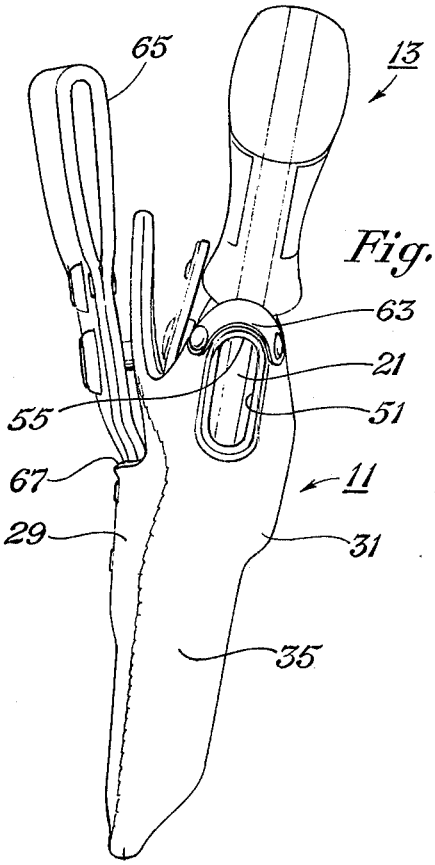
FIG. 2 is a rear elevational view of FIG. 1.

Referring to FIGS. 1 and 2, the external layer 37 wraps around the rear edge 35 and is sewn to the outer side adjacent the front edge 33. Stitching on the forward edge 33 as opposed to the more conventional rear edge stitching is known in the art. It has the advantage of providing an integral rear edge 35. If the stitching is in the rear, an assailant could break through the stitches by drawing rearward, particularly if the holster is well-worn. The pocket 27 of the holster tapers inwardly toward the bottom. With respect to the vertical direction as shown in the drawings, the forward edge 33 lies at an angle of approximately 20° while the rearward edge 35 lies at an angle of approximately 10°.

A strap 45 formed integrally with the outer side 31 bends over the hammer 23 and releasably fastens to a tab 47. On the upper rear of the body of the holster, a trigger guard pocket 49 is formed to receive the trigger guard member 21. The rearward edge 35 adjacent the trigger guard pocket 49 has a slot 51, FIG. 2, through which a portion of the trigger guard member 21 protrudes. Consequently the trigger guard pocket 49 may be defined as a non-releasable, immovable strap connected integrally between the inner side 29 and outer side 31 adjacent the trigger guard member. The upper portion or strap 53 of the trigger guard pocket 49 has a lower edge 55 that is adjacent a point in the upper half of trigger guard member 21, but not in the upper one-fourth. Referring to the reference axes 57 superimposed upon the trigger guard member, the lower edge 55 is located at approximately 150°. Slot 51 is approximately 1 ⅝ inch in length with the bottom of the slot at approximately 270° or between the third and fourth quadrants.

Arrow 59 indicates the normal direction of drawing the pistol, which is parallel to the axis of barrel 17. If the pistol 13 is drawn in the direction along arrow 59, strap 53 will provide little interference or drag, allowing the pistol to be freely withdrawn. Attempting to draw the pistol 13 in any direction rearward of that shown by angle 59 would cause trigger guard member 21 to press against strap 53. Arrow 61 represents a typical direction in which one from the rear would attempt to draw the pistol. In this direction a substantial drag would be exerted, and if the holster is held immovable with respect to the vertical direction by the belt 15, it is virtually impossible to draw the pistol out. Strap 53 is approximately ½ inch in width, the top edge being aligned with the top edge of the trigger guard member 21. A metal reinforcing strap 63 is fastened across strap 53 to increase its rigidity. Without metal strap 63, the leather strap 53 tends to wear and soften as the pistol is inserted and withdrawn.

A belt loop assembly 65 is attached to the inner side 29 of the holster body for carrying the holster. The belt loop assembly 65 comprises a substantially flat piece of holster material inserted within a slot 67 in the inner side 29 of the holster and fastened by rivets 69. Slot 67 is located in the upper portion of the holster adjacent the trigger guard pocket 49. The upper portion of the belt loop assembly 65 contains a loop 70 having inner and outer sides 71, 73 for the reception of belt 15. A metal reinforcing plate 75 is interposed between the layers of the outer side 73, as shown in FIG. 5. The metal plate extends down through the slot, bending at a predetermined angle, and contains holes for the insertion of the three rivets 69. Metal plate 75 is preferably tempered steel and may be stiffer than the reinforcing metal plate 41 that is located in the inner side of the holster body.

Figure 4:
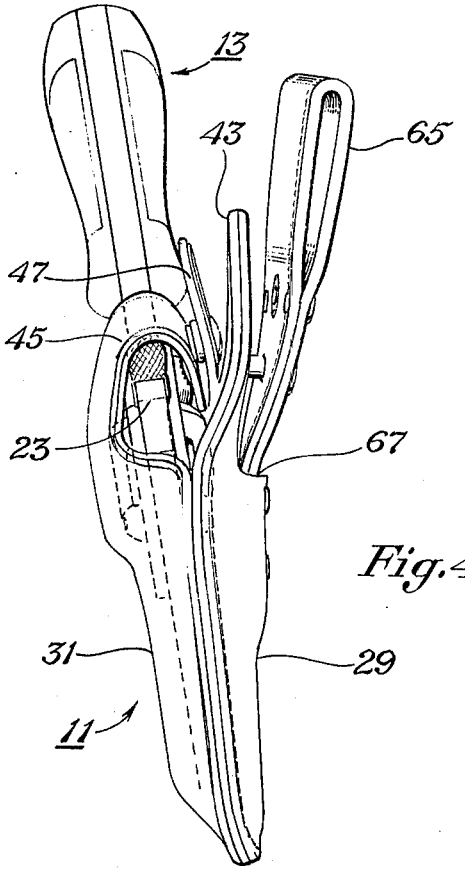
FIG. 4 is an elevational view of the front side of the holster of FIG. 1.

A screw 77 is threaded into a receptacle 79 between the belt loop assembly 65 and upper portion 43 of the inner side of the holster. Screw 77 is approximately midway between the slot 67 and the bottom of loop 70. Screw 77 serves as an adjusting means for selectively varying the inclination of the body of the holster with respect to the belt loop assembly and for preventing movement of the holster with respect to the belt loop assembly. Rotating screw 77 changes the space between the upper portion 43 of the inner side of the holster in the belt loop assembly 65. FIGS. 2 and 4 show the screw 77 adjusted so that there is a substantially wide gap, while FIG. 5 shows screw 77 tightened so that there is a smaller gap.

Figure 3:
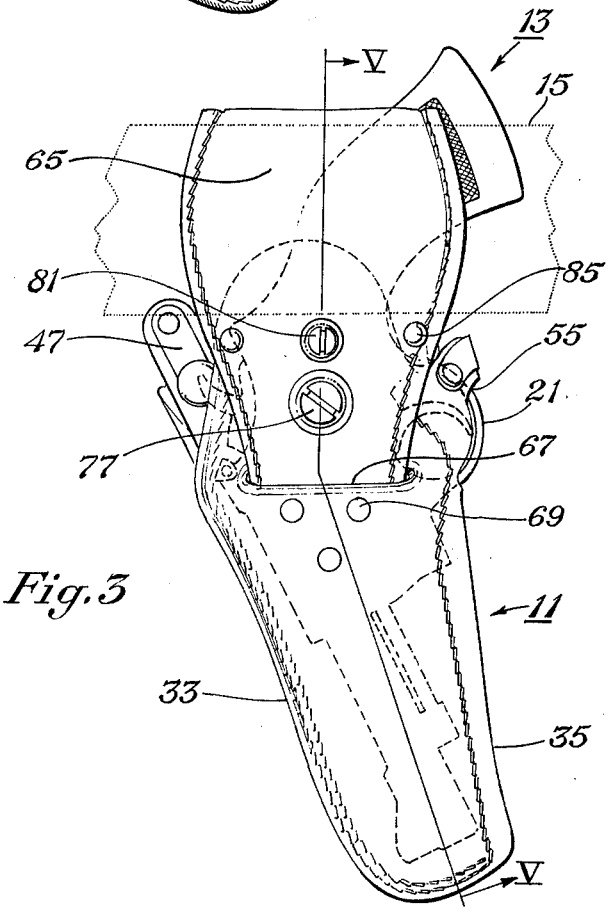
FIG. 3 is an elevational view from the inner side of the holster of FIG. 1.

Referring to FIGS. 3 and 5, a second screw 81 is threaded into a receptacle 83 adjacent the bottom of the loop 70 between inner and outer sides 71, 73. Screw 81 is located so that a properly sized belt may be inserted within the loop. Tightening screw 81 into receptacle 83 draws the bottom of the loop together, squeezing the belt 15 to prevent movement of the holster along the belt. Rivets 85, on opposite sides of the screw and aligned with the bottom of the loop, add further strength.

In operation the pistol 13 is located within the gun receiving pocket 27, which snugly fits about the pistol body and barrel. Safety strap 45 is normally fastened to its tab 47 over hammer 23. Trigger guard member 21 will be received within the trigger guard pocket 49, with the lower edge 55 of strap 53 closely adjacent the trigger guard member in the lower half of the upper left, or second quadrant, as shown in FIG. 1. Belt 15 is threaded through the loop 70, and screw 81 is tightened to wedge the belt tightly within the loop. Screw 77 is selectively tightened within its receptacle to the desired inclination of the belt loop assembly 65 with respect to the holster body. If the officer is wearing a jacket, he may wish for the jacket to be carried in the gap between the upper portion 43 of the inner side and the belt loop assembly 65. In this case the gap is set fairly wide. If the officer is not wearing a jacket, the gap should remain fairly narrow, for example between ½ inch and ¾ inch at the top, so that handle 25 of the pistol remains fairly close to the belt loop assembly 65.

Should the officer desire to withdraw the pistol, safety strap 45 is released, and the pistol is pulled upwardly substantially along the axis of its barrel 17, as shown by arrow 59. While pulled in this direction, little or substantially no drag will be exerted by strap 53 of the trigger guard pocket. Should an assailant attempt to withdraw the pistol from a rearward direction with respect to the axis of barrel 17, such as along arrow 61, FIG. 1, trigger guard member 21 will press firmly against strap 53, preventing the withdrawal. Screw 81 and rivets 85 will prevent any movement of the belt loop assembly with respect to the belt, holding the holster in its proper inclination as shown in FIG. 1. Screw 77 adds rigidity to the connection between the belt loop assembly 65 and holster body, preventing bending or tearing.

It is accordingly seen that an invention having significant improvements has been provided. An improved safety feature for an upward-drawn type holster is provided to prevent withdrawal of the pistol from the rear. The trigger guard pocket allows the pistol to be drawn freely in the normal upward direction, yet exerts a substantial drag if the pistol is attempted to be withdrawn in a rearward direction. The adjusting means connected between the belt loop assembly and holster body allows the user to select the desired amount of space between the belt loop and the pistol handle. Should the metal reinforcing plates be accidentally bent by the user, the bend may be corrected to a substantial extent by rotating the adjusting means. Since the reinforcing plates of the belt loop assembly and the holster body are connected by rivets at one point and by the adjusting means at another point, bending or tearing by an assailant is virtually impossible. The second adjusting means located at the bottom of the loop wedges the belt tightly to the belt loop assembly, preventing slippage. As the loop wears, the second adjusting means may be tightened further to account for the softening of the holster material.

The foregoing disclosure and the showings made in the drawings are merely illustrative of the principles of this invention and are not to be interpreted in a limiting sense.

I claim:

1. A holster for a pistol comprising:

a body of flexible material having inner and outer sides closed at the front and rear to define a pistol receiving pocket with the top open for the pistol to be inserted and withdrawn; the pocket being of a size so as to prevent substantially any lateral movement of the pistol;

a substantially rigid trigger guard pocket in the upper rear portion of the body to receive the trigger guard member, the trigger guard pocket extending upwardly around and past the center of the trigger guard member so that the trigger guard pocket will exert a substantial drag on the trigger guard member if the pistol is drawn in a rearwardly direction with respect to the axis of the barrel;

a belt loop assembly having its lower end connected to the body of the holster; and a screw and receptacle, connected between the lower end of the belt loop assembly and the inner side of the holster, for selectively varying the angle of inclination of the body of the holster with respect to the belt loop assembly, the space between the inner side of the holster and the belt loop assembly above the screw being free of obstructions to allow a jacket to be inserted within.

* * * * *